US008943726B2

(12) United States Patent
Kincel

(10) Patent No.: US 8,943,726 B2
(45) Date of Patent: Feb. 3, 2015

(54) SPRING ENHANCED BUFFER FOR A FIREARM

(71) Applicant: Eric Stephen Kincel, Tucson, AZ (US)

(72) Inventor: Eric Stephen Kincel, Tucson, AZ (US)

(73) Assignee: Abrams Airborne Inc., Tucson, AZ (US)

( * ) Notice: Subject to any disclaimer, the term of this patent is extended or adjusted under 35 U.S.C. 154(b) by 172 days.

(21) Appl. No.: 13/573,480

(22) Filed: Sep. 17, 2012

(65) Prior Publication Data

US 2014/0075798 A1 Mar. 20, 2014

(51) Int. Cl.
*F41A 21/00* (2006.01)
*F41A 3/84* (2006.01)
*F41C 23/06* (2006.01)

(52) U.S. Cl.
CPC .. *F41A 3/84* (2013.01); *F41C 23/06* (2013.01)
USPC ..... 42/1.06; 42/71.01; 42/73

(58) Field of Classification Search
USPC ..... 42/1.06, 71.01, 73
See application file for complete search history.

(56) References Cited

U.S. PATENT DOCUMENTS

| | | | | |
|---|---|---|---|---|
| 5,909,002 | A * | 6/1999 | Atchisson | 89/130 |
| 6,688,031 | B2 * | 2/2004 | Steele | 42/73 |
| 7,131,367 | B1 * | 11/2006 | Boerschig et al. | 89/198 |
| 7,827,722 | B1 * | 11/2010 | Davies | 42/75.02 |
| 8,296,984 | B2 * | 10/2012 | Kincel | 42/1.06 |
| 8,297,175 | B1 * | 10/2012 | Davies | 89/191.01 |
| 8,430,015 | B2 * | 4/2013 | Faifer | 89/44.01 |
| 2008/0110074 | A1 * | 5/2008 | Bucholtz et al. | 42/1.06 |
| 2010/0251587 | A1 * | 10/2010 | Kincel | 42/1.06 |
| 2010/0251588 | A1 * | 10/2010 | Kincel | 42/1.06 |
| 2010/0275489 | A1 * | 11/2010 | Cabahug et al. | 42/71.01 |

* cited by examiner

*Primary Examiner* — Samir Abdosh
(74) *Attorney, Agent, or Firm* — Mark Ogram

(57) ABSTRACT

A buffer for a firearm having a sleeve member having an open end and a closed end. A set of weights having a combined predefined mass are contained within the sleeve member. A bumper secures and seals the open end of the sleeve. A spring is positioned between two of the weights within the sleeve to maintain the mass at a predetermined location when the buffer is in an at-rest position.

13 Claims, 8 Drawing Sheets

SPRING ENHANCED BUFFER FOR A FIREARM

This is a continuation in part of U.S. patent application Ser. No. 12/655,984, filed on Jan. 11, 2011, and entitled "Spring Enhanced Buffer for a Firearm", now U.S. Pat. No. 8,296,984, which was a continuation in part of U.S. patent application Ser. No. 12/384,354, entitled "Versatile Buffer/Spring Assembly for a Firearm" filed on Apr. 3, 2009.

BACKGROUND OF THE INVENTION

This invention relates generally to firearms and more particularly to the stock tube/spring/buffer combination used in automatic and semi-automatic rifles and carbines and the M16/AR15.

The M16/AR15 series of rifles was originally designed to use a twenty inch barrel; with the gas port located approximately thirteen inches from the breach. The original design also used an operating spring and buffer system designed specifically for the fixed stock.

As the battlefield changed, so too did the methods and tactics used by our military forces. These changes demanded that the individual weapon become shorter, more compact and easier to handle in confined spaces. This was ultimately accomplished by shortening the weapon's barrel and developing a telescoping stock system, which allowed the user to select varying degrees of "length of pull". This telescoping stock system also used a new shorter action spring and was/is unable to use the existing action spring from the rifle version.

The new, shorter weapon is called a "carbine". One of the shortcomings of the carbine is that when the barrel is shortened, the location of the gas port was also moved closer to the breach. The high pressure gases that are bled off at this port are what provide the energy for the weapon to operate; however, the gas pressures of the new shorter carbine system are nearly double what the original system was designed to do. This causes significantly higher operating pressures and forces the weapon to operate at much higher cyclic rates and with a noticeably increased bolt velocity.

To counter this, the carbine action spring is stiffer than the rifle action spring, and the functional length of the carbine spring is much shorter than the rifle spring. Attempts to run the longer rifle length barrel on a weapon with the shorter carbine length recoil system (collapsible stock tube, spring, and buffer) have proven to be an unreliable design.

This means that the two weapons, the rifle and carbine, require different combinations of stock tube, spring, and buffer in order to operate properly; otherwise, the weapons are not reliable; thereby forcing an expanded inventory of replacement and manufacturing parts.

It is clear there is a need for an improved stock tube/buffer/spring assembly to improve reliability and also decrease the complexity of the firearm systems.

SUMMARY OF THE INVENTION

The invention relates to a collapsible stock for a firearm and the improved firearm using such stock. While there are many firearms, this invention is particularly useful for a firearm which has models ranging from a carbine to a rifle (barrel length between seven inches and twenty four inches).

Such firearms are described in U.S. Pat. No. 6,637,142, entitled "Firearm Assembly" issued to Reynolds on Oct. 28, 2003; U.S. Pat. No. 6,487,805, entitled "Firearm Assembly" issued to Reynolds on Dec. 3, 2002; and U.S. Pat. No. 7,448, 307, entitled, Gas Operated Semi-Automatic Rifle" issued to Dafinov, on Nov. 11, 2008; all of which are incorporated hereinto by reference.

The firearm uses an action mechanism to discharge a cartridge so that a bullet travels through the barrel. Those of ordinary skill in the art readily recognize a variety of action mechanisms, such as, but not limited to, U.S. Pat. No. 4,433,610, entitled "Open Bolt Firing Mechanism for Automatic Firearm" issued to Tatro on Feb. 28, 1984; U.S. Pat. No. 6,722,255, entitled "Apparatus and Method for Actuating a Bolt Carrier Group as a Receiver Assembly" issued to Herring on Apr. 20, 2004; U.S. Pat. No. 7,461,581m, entitled "Self-Cleaning Gas Operating System for a Firearm" issued to Leitner-Wise on Dec. 9, 2008; U.S. Pat. No. 7,418,898, entitled "M16 Modified With Push Rod Operating System and Conversion Thereof" issued to Desomma on Sep. 2, 2008; and, U.S. Pat. No. 6,851,346, entitled "Firearm Bolt Catch Assembly" issued to Herring on Feb. 8, 2005; all of which are, incorporated hereinto by reference.

A collapsible stock permits the firearm to be used in a variety of situations (e.g. to facilitate close quarters operations such as within a building), by users of varying arm length and height, and to accommodate other equipment (e.g. thick body armor).

Collapsible stocks are well known in the art. Examples of such are described in U.S. Pat. No. 6,925,744, entitled "Modular Firearm Buttstock" issued to Kincel on Aug. 9, 2005; and, U.S. Pat. No. 7,363,740, entitled "Modular Firearm Buttstock" issued to Kincel on Apr. 29, 2008; both of which are incorporated hereinto by reference.

Further, in the case of the M16/AR14 rifle and carbine, the collapsible stock assembly assists the action mechanism in ejecting a spent cartridge and injecting a fresh cartridge into the action. In this context, the collapsible stock slides upon a stock tube. Within the stock tube is a spring working with a buffer mass which assists the action mechanism in ejecting the spent cartridge.

Such collapsible stock assemblies for the M16 and AR14 rifles are described in U.S. Pat. No. 4,057,003, entitled "Open Bolt Conversion Apparatus" issued to Atchisson on Nov. 8, 1977; and, U.S. Pat. No. 6,971,202, entitled "Gas Operated Action for Auto-Loading Firearms" issued to Bender on Dec. 6, 2005; both of which are incorporated hereinto by reference.

In the present invention, the stock tube ideally has a working length of 7.771 inches although a working length of between 7.5 and 8 inches is also operable as indicated below. This is the length from the open end to the base of the stock tube.

In some embodiments of the invention, a plate with screw adjustment is provided in the stock tube, permitting the working length to be adjusted by user to obtain specific operating characteristics.

The present invention provides a system which uses a stock tube with a single uniform spring and associated buffer regardless of the length of the barrel of the firearm; hence, a single spring is used for reliable operation of a firearm whether that firearm is a carbine (typically requiring a shorter, more durable spring), or a rifle, (requiring a less durable spring for reliable operation).

The preferred spring used for either the carbine (barrel length as short as seven inches) or the rifle (barrel length up to twenty-four inches) is that described in MIL-W-13855, incorporated hereinto by reference.

The buffer used in this invention is made from a sleeve member having an open end and a closed end and has a diameter (except for an engaging collar) less than a diameter of said spring, thereby allowing the buffer to fit within the spring (except for the collar at one end of the buffer). In the preferred embodiment, four weights are contained within the sleeve member and are chosen so that the total mass of the assembled buffer is between 4.2 and 5.1 ounces. A bumper (ideally made from plastic) is secured to the open end of the sleeve member to seal the open end of said sleeve member and contain the weights therein.

In one aspect of the present invention, a unique buffer is established. As described above, the buffer is a sleeve having an open end and a closed end. A mass is contained within the sleeve member. Ideally this mass, as described above, is made up of four different weights having two or more individual masses. The total mass of the weights is chosen to meet the demands of the particular firearm.

As before, a bumper secures and seals the open end of said sleeve. In this improved buffer, a spring is contained within the sleeve to maintain the mass at a predetermined location when the buffer is in an at-rest position.

The spring, by maintaining the mass at pre-determined location within the buffer during at-rest conditions (e.g. except for when the weapon is discharged), eliminates any noise or "rattling" sounds from the buffer when the firearm is carried or moved.

Even further, this placement of the mass at a standard location before discharge of the firearm provides for enhanced accuracy since the mass is consistently placed in one position, thereby eliminating variations.

The improved buffer provides for improved reliability and enhanced accuracy as well as a silencing of the mechanism.

The invention, together with various embodiments thereof, will be more fully explained by the accompanying drawings and the following descriptions thereof.

DRAWINGS IN BRIEF

Figures 6A, 6B, 6C:
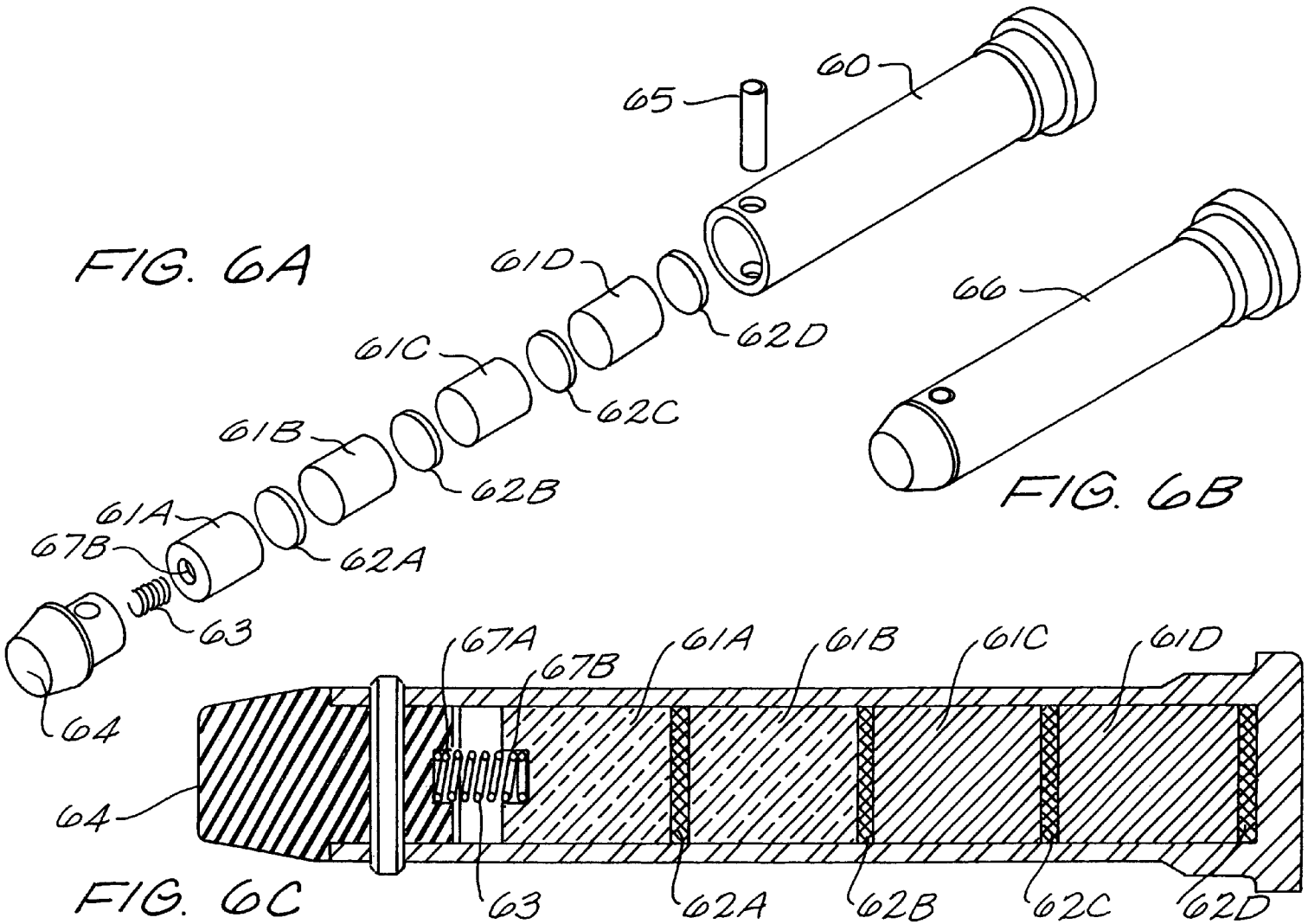

FIGS. 6A, 6B, and 6C are exploded, assembled, and cutaway views of the preferred spring loaded buffer.

Figure 7A:
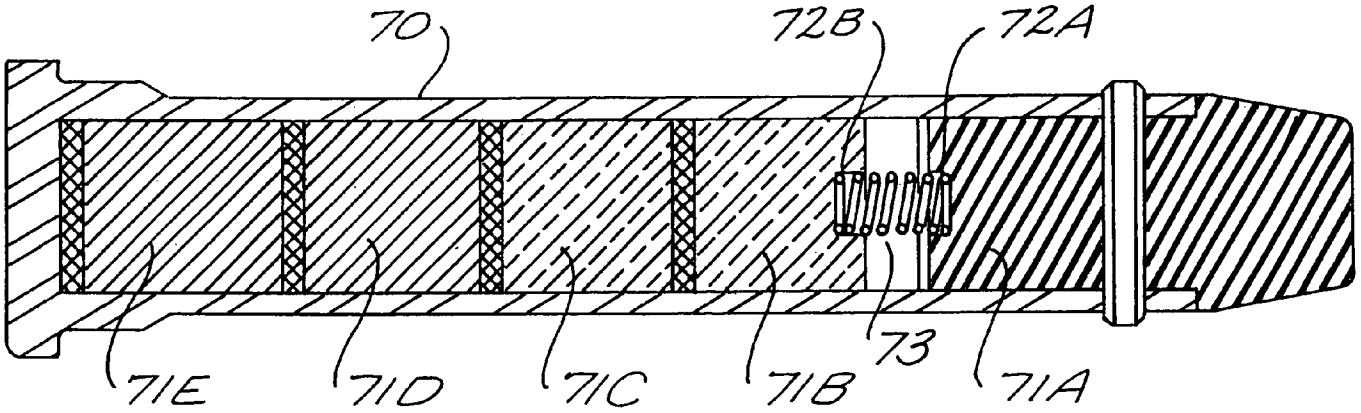
Figure 7B:
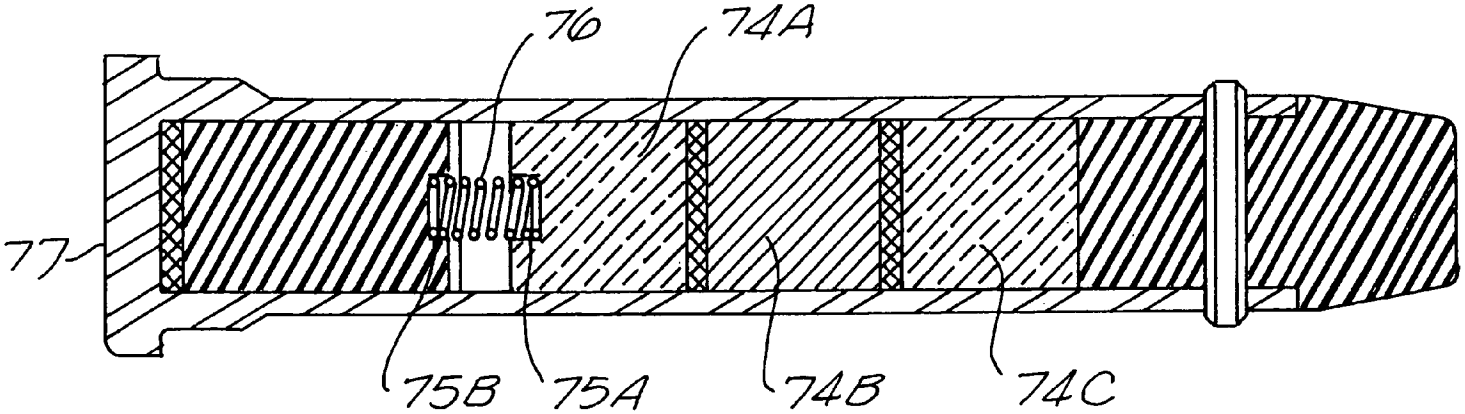

FIGS. 7A and 7B are cutaway views of alternative embodiments of the spring loaded buffer.

Figure 8:
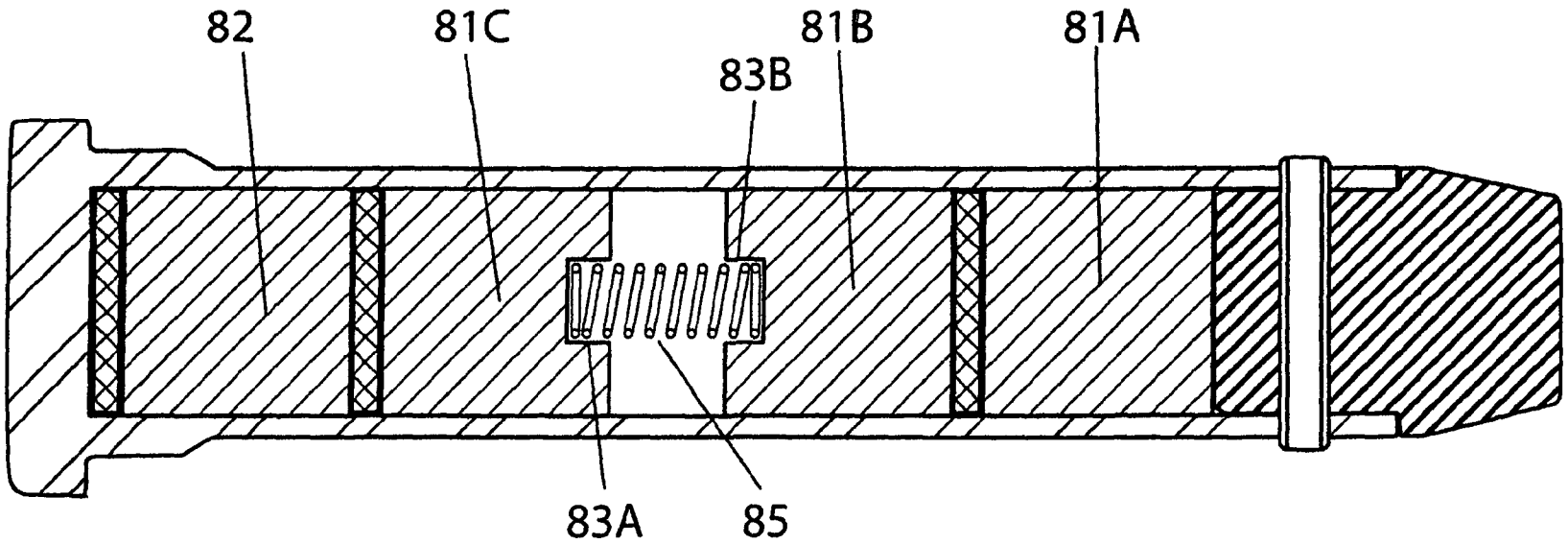

FIG. 8 illustrates an alternative spring/weight combination within the buffer.

Figure 9:
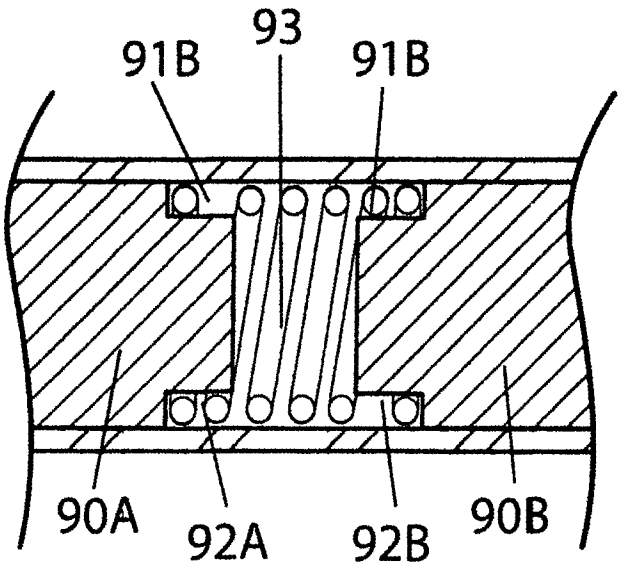

FIG. 9 illustrates an alternative nesting arrangement for the spring/weight combination within the buffer.

DRAWINGS IN DETAIL

Figure 1:
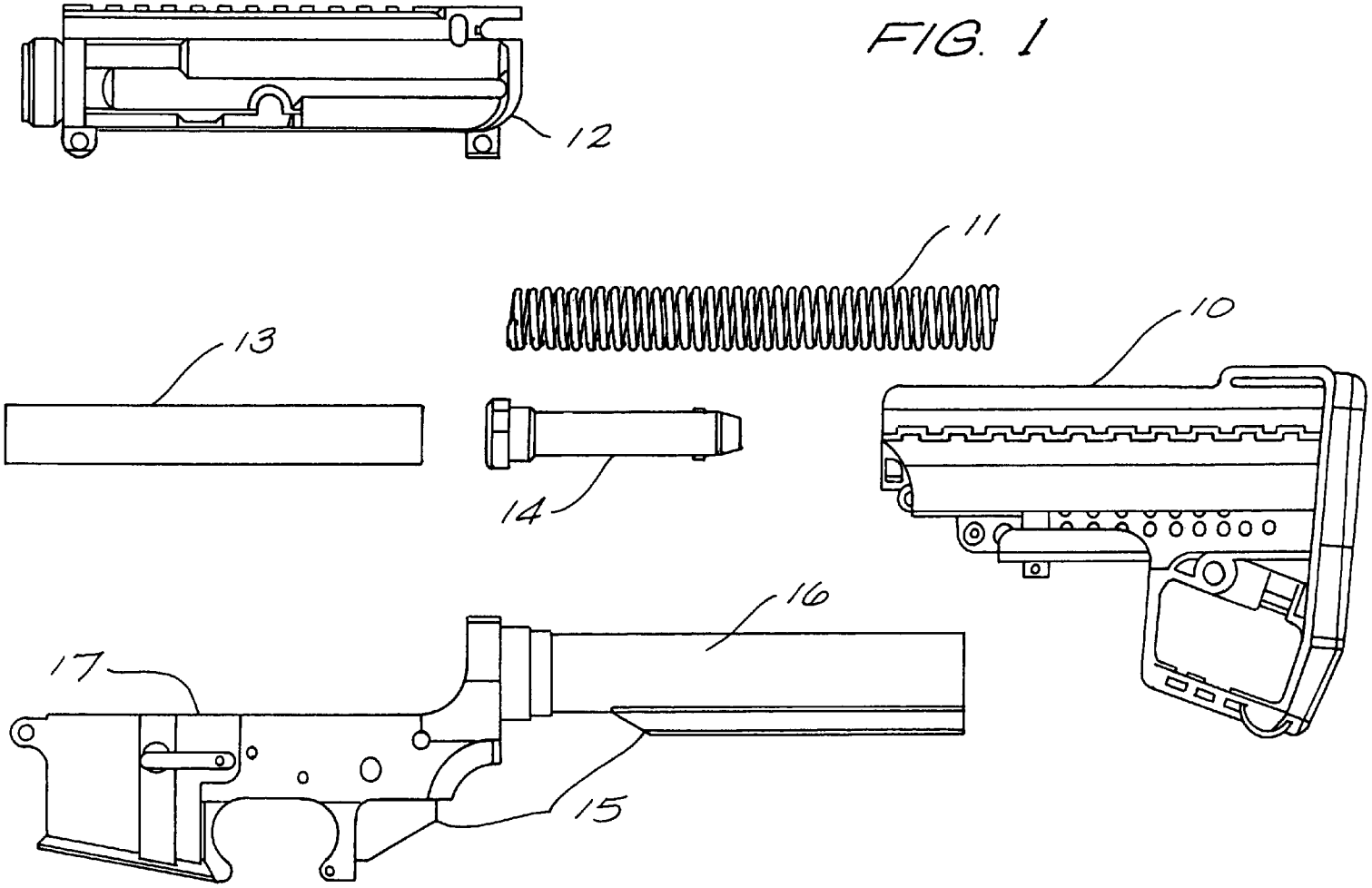
FIG. 1 is an illustration of the parts used in the present invention.

FIG. 1 is an illustration of the parts used in the present invention. Upper receiver 12 is configured to engage mechanism 17 and contain the bolt carrier 13 therebetween. Mechanism 17 includes a stock tuber 16 which is configured to accept butt member 10 (sliding on stock tube 16) and selectively engaging with lower receiver 15.

Stock tube 16 is configured to accept spring 11 therein as well as buffer 14. Spring 11 complies with MIL-W-13855. With a wire diameter of 0.072 inches, 44 coils, a spring rate 1.35 and a free length of 12.5 inches, spring 11 reliably operates a firearm having a barrel length ranging from a carbine length (7 inches) to a rifle length (24 inches).

Buffer 14 has an overall length of between 3.8 and 4.1 inches and a mass of between 4.2 and 5.1 ounces. This length/mass combination of buffer 14 assures that the operation of the firearm, regardless of the barrel length, is reliable and steady.

To accommodate spring 11 and buffer 14, stock tube 16 has an internal operating length of between 7.5 and 8 inches; ideally the internal operating length is 7.771 inches. This length allows lower receiver 15 to fully accept the spring 11//buffer 14 combination and has seven engaging points so that butt member 10 is given seven degrees of freedom for optimal operator satisfaction.

Figure 2:
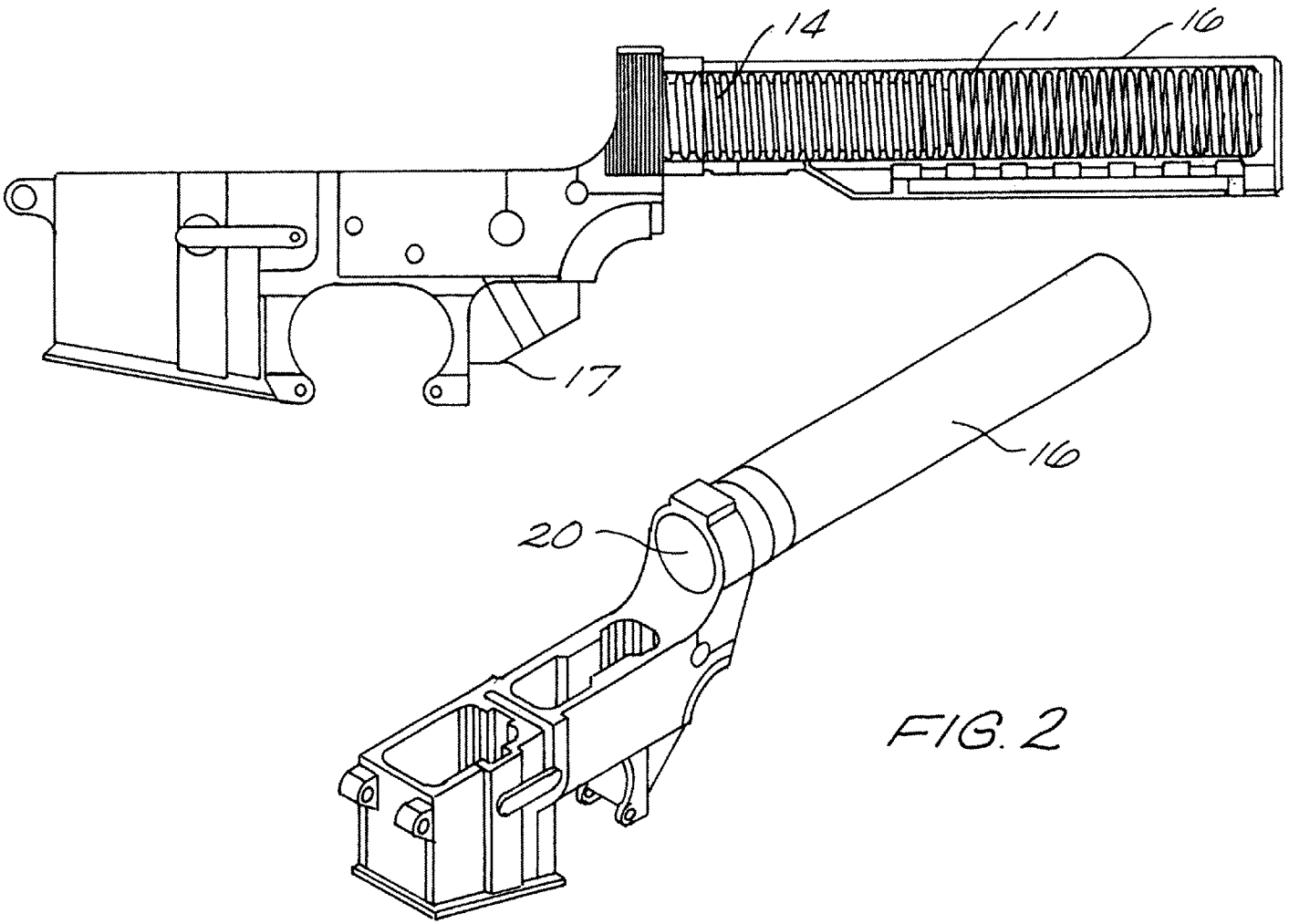
FIG. 2 illustrates the spring and buffer placed within the hollow receiver.

FIG. 2 illustrates the spring and buffer placed within the hollow receiver. Hollow receiver 16 now contains spring 11 and buffer 14. As noted earlier, the internal length of hollow receiver 16 (operating length) is 7.771 inches, allowing spring 11 and buffer 14 to be properly contained therein. Placement of spring 11 and buffer 14 within hollow receiver 16 is via opening 20.

Figure 3:
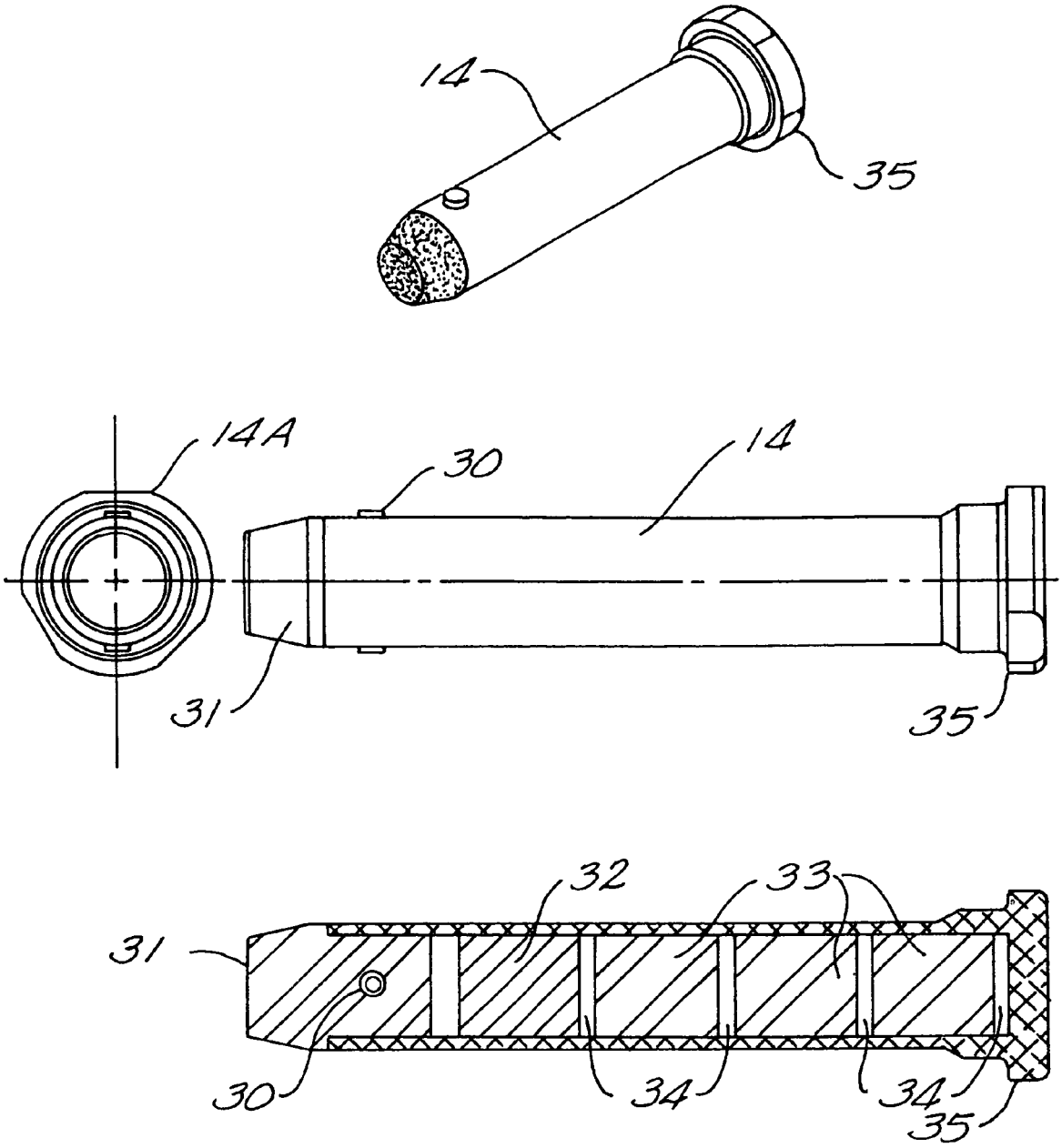
FIG. 3 illustrates the components of the inventions preferred buffer.

FIG. 3 illustrates the components of the invention's preferred buffer. Buffer 14 includes collar 35 which is designed to rest on the end of the spring (not shown) as illustrated in FIG. 2.

Buffer 14 is hollow and contains weights 32 and 33 therein which are separated by discs 34. Tungsten weight 32 is denser and hence heavier than steel weights 33. By selective application of the number of tungsten weights 32 and steel weights 33, the overall mass of buffer 14 is established in the range of 3.8 ounces to 4.1 ounces.

Plastic plug 31 is used to contain weights 32 and 33 within buffer 14. Plastic plug 31 is held in place with pin 30.

Figures 4, 5:
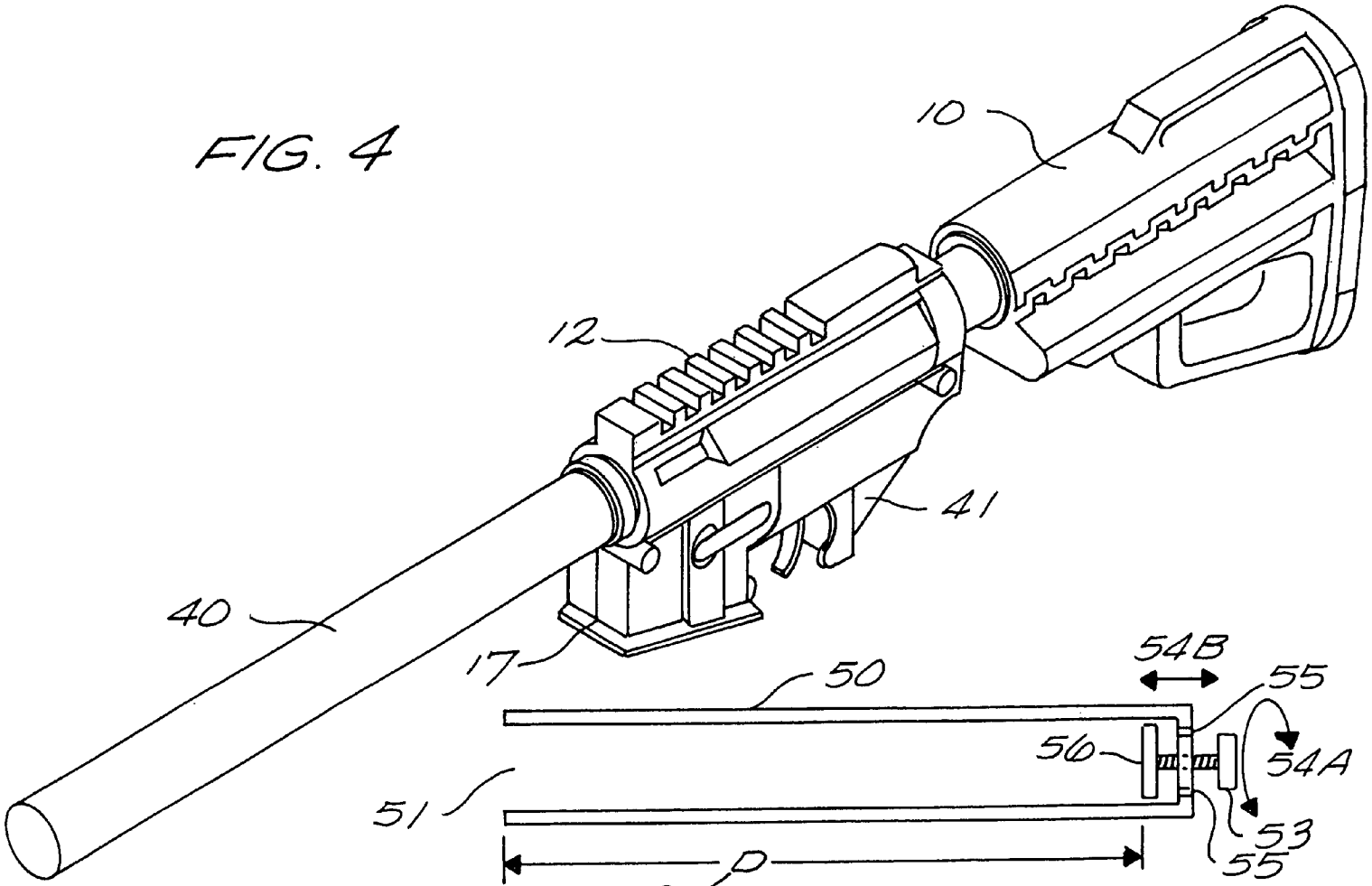
FIG. 4 is a perspective view of the assembled firearm.
FIG. 5 is a view of an embodiment of the hollow receiver which has an adjustable effective length.

FIG. 4 is a perspective view of the assembled firearm. Once assembled, the firearm of FIG. 4 has a butt member 10, an action 41 (including upper receiver 12), and barrel 40. Internal to mechanism 17 is the stock tube/spring/buffer as discussed before. While the stock tube/spring/buffer within mechanism 17 is constant, the barrel length is chosen to meet the specific requirements of the time or application. The length of barrel 40 is now able to range from seven inches to twenty-four inches without having to modify the stock tube/spring/buffer.

FIG. 5 is a view of an embodiment of the stock tube which has an adjustable effective length. In this embodiment of the stock tube, stock tube 50 has opening 51 which permits the insertion of the spring/buffer as discussed above. This embodiment of hollow receiver 50 allows the adjustment of the effective length D, 52, by way of base plate 56 which is moved within the stock tube 50 by screw mechanism 53. Motion of screw 53, as indicated by arrow 54A, causes base plate 56 to move, as indicated by arrow 54B. This allows adjustment of the overall length D, 52, so as to adjust the tension/response of the spring/buffer (not shown).

Weep holes 55 permit water which might be collected within hollow receiver 50 during use in the field to be exhausted.

FIGS. 6A, 6B, and 6C are exploded, assembled, and cutaway views of the preferred spring loaded buffer.

Referring to FIGS. 6A and 6B, the enhanced buffer utilizes a sleeve 60 into which is placed a series of pads (62A, 62B, 62C, and 62D) and weights (61A, 61B, 61C, and 61D). Weight 61A has recess 67B therein which accepts one end of spring 63. Another recess 67A is formed in the bumper 64 to receive the other end of spring 63. Pin 65 secures bumper 64 to sleeve 60.

When assembled, as is illustrated in FIG. 6B, spring 63 maintains the pads (62A, 62B, 62C, and 62D) and weights (61A, 61B, 61C, and 61D) juxtaposed away from bumper 64.

When the firearm is discharged, spring 63 collapses allowing pads (62A, 62B, 62C, and 62D) and weights (61A, 61B, 61C, and 61D) to move as outlined above for proper operation of the firearm.

The assembled buffer as shown in FIG. 66 is configured to work as outlined above.

The assembly, by maintaining the mass at pre-determined locations within the buffer during at-rest conditions (e.g. except for when the weapon is discharged), eliminates any noise or "rattling" sounds from the buffer when the firearm is moved, and by placing the weights at a standard location before discharge of the firearm, accuracy is enhanced due the consistency provided.

FIGS. 7A and 7B are cutaway views of alternative embodiments of the spring loaded buffer.

Referring to FIG. 7A, in this embodiment of the buffer, five weights are used (71A, 71B, 71C, 71D, and 71E). Recesses 72A and 72B are formed in weights 71A and 71B respectively to hold opposing ends of spring 73.

As before, spring 73 maintains weights (71A, 71B, 71C, 71D, and 71E) in a secure position while buffer 70 is at rest (not during discharge of the firearm). When the firearm is discharged, spring 73 compresses and permits movement of the weights (71A, 71B, 71C, 71D, and 71E) to move as outlined above; between discharge, spring 73 moves weights (71A, 71B, 71C, 71D, and 71E) back into proper position.

FIG. 7B is another alternative embodiment of the enhanced buffer. In this embodiment, three weights (74A, 74B, and 74C) are used. Weight 74A includes recess 75A which holds one end of spring 76; the other end of spring 76 is secured within recess 75B formed in the end of sleeve 77.

FIG. 8 illustrates an alternative spring/weight combination within the buffer.

Within the buffer are weights 81A, 81B, 81C, and 82. Weight 81C has nest 83A; weight 81B has nest 83B. Between weights 81C and 81B is spring 85 which is secured in place by nest 83B and 83A.

While movement of the buffer will cause the weights to shift, spring 85 will force the weights back into the desired positions once the buffer ceases movement.

Although this illustration shows a single spring interposed between the weights, the invention is not so limited and includes any arrangement of springs, such as, but not limited to, three smaller springs in a triangular set of nests.

FIG. 9 illustrates an alternative nesting arrangement for the spring/weight combination within the buffer.

In this illustration, weights 90A and 90B are shaped to have nests 91A/92A and 91B/92B respectively. These nests allow spring 93 to be positioned next to the walls of the buffer and to perform the functions outlined above.

It is clear from the foregoing that the present invention creates a highly reliable and versatile assembly for a firearm such as the M16/AR14.

What is claimed is:

1. A buffer for a firearm comprising:

a) a sleeve member having an open end and a closed end, except for a collar thereon, said sleeve member having a uniform diameter;

b) at least four weights contained within said sleeve member, at least one of said weights having a mass greater than the mass of another weight;

c) at least one spring contained within said sleeve and positioned between two weights within the sleeve member; and, d) a bumper secured to and sealing the open end of said sleeve member.

2. The buffer for a firearm according to claim 1, wherein said at least two weights on either end of said at least one spring contain nesting locations, each nesting location containing an end of a spring.

3. The buffer for a firearm according to claim 1, wherein the at least one spring is a single spring and wherein a center axis of said single spring is substantially aligned with a central axis of said sleeve member.

4. The buffer for a firearm according to claim 3, wherein said single spring is located proximal to an interior wall of said central sleeve.

5. The buffer for a firearm according to claim 3, wherein said single spring is located distal to an interior wall of said central sleeve.

6. A weight system for buffer for a firearm comprising:

a) at least four weights contained within a sleeve member of the buffer; and, b) at least one spring contained within said sleeve and positioned between two weights within the sleeve member.

7. The weight system for a buffer for a firearm according to claim 6, wherein said at least two weights proximal to said at least one spring each contain nesting locations for securing the spring therebetween.

8. The weight system for a buffer for a firearm according to claim 6, wherein the at least one spring is a single spring and wherein a center axis of said single spring is substantially aligned with a central axis of said sleeve member.

9. The buffer for a firearm according to claim 8, wherein said single spring is located proximal to an interior wall of said central sleeve.

10. A buffer for a firearm comprising:

a) a sleeve member having an open end and a closed end, except for a collar thereon, said sleeve member having a uniform diameter;

b) at least three weights contained within said sleeve member, each of said at least three weights having substantially identical mass;

c) a spring contained within said sleeve and positioned between two weights within the sleeve member; and, d) a bumper secured to and sealing the open end of said sleeve member.

11. The buffer for a firearm according to claim 10, wherein said at least two weights on either end of said spring contain nesting locations, each nesting location securing opposing ends of the spring.

12. The buffer for a firearm according to claim 11, wherein said spring is located proximal to an interior wall of said central sleeve.

13. The buffer for a firearm according to claim 11, wherein said spring is located distal to an interior wall of said central sleeve.

* * * * *